US006488485B1

(12) United States Patent
Rupp et al.

(10) Patent No.: US 6,488,485 B1
(45) Date of Patent: Dec. 3, 2002

(54) COOLING FAN

(75) Inventors: Bernhard Rupp, Sulzfeld (DE); Gerd Knoepfel, Buehl (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/446,534

(22) PCT Filed: May 6, 1999

(86) PCT No.: PCT/DE99/01360

§ 371 (c)(1),
(2), (4) Date: Dec. 28, 1999

(87) PCT Pub. No.: WO99/60277

PCT Pub. Date: Nov. 25, 1999

(30) Foreign Application Priority Data

May 15, 1998 (DE) ..... 198 21 833

(51) Int. Cl.[7] ..... F04B 17/00; F04B 35/04
(52) U.S. Cl. ..... 417/423.7; 417/352; 415/119
(58) Field of Search ..... 417/423.7, 423.4, 417/420, 354, 353, 352; 415/119, 220; 318/254

(56) References Cited

U.S. PATENT DOCUMENTS 4,128,364 A * 12/1978 Papst et al. ..... 417/354
4,164,690 A * 8/1979 Muller et al. ..... 318/254
4,428,719 A * 1/1984 Hayshibara et al. ..... 417/354
5,028,216 A * 7/1991 Harmsen et al. ..... 417/354
5,217,353 A * 6/1993 De Filippis ..... 417/368
5,281,106 A * 1/1994 Reinhardt et al. ..... 417/354
5,944,497 A * 8/1999 Kershaw et al. ..... 417/423.8

FOREIGN PATENT DOCUMENTS

DE 36 38 393 A1 * 11/1986
DE 36 24 386 A1 * 1/1988

* cited by examiner

*Primary Examiner*—Cheryl J. Tyler
*Assistant Examiner*—Han L. Liu
(74) *Attorney, Agent, or Firm*—Ronald E. Greigg

(57) ABSTRACT

Cooling fan with a fan wheel equipped with blades and an electric motor that has a stator and a rotor that is supported in a rotationally fixed manner on a driven shaft. For a purpose of a cost-saving and compact design of the cooling fan with low fan noise, the rotor is embodied as an external rotor with a bell-shaped pole housing encompassing the stator. The fan wheel is rotationally fixed in relation to the pole housing so that the fan wheel axially encompasses the pole housing at least partially and contacts the outer circumference of the pole housing at a number of points.

22 Claims, 3 Drawing Sheets

COOLING FAN

PRIOR ART

The invention is based on a cooling fan, in particular for vehicles.

In a known cooling fan of this type, also called a ventilator or blower, (DE 43 29 804 A1), the fan wheel is pressed against the motor shaft and, in order to fasten the motor to a component in the vehicle, a mount is provided which secures the electric motor on its stator which constitutes the pole housing. The mount is manufactured in two parts comprising a motor mount and an adapter, and a number of rubber-elastic support elements are disposed between the motor mount and adapter, which vibrationally decouple the unit made up of the electric motor and the fan wheel and consequently damp a noise transmission to the vehicle parts.

In electric motors of the external rotor type (DE 196 52 263.3), in order to reduce the structurally induced intense noise generation of an external rotor, the proposal has already been made to produce the bell-, cap-, or cup-shaped pole housing encompassing the stator out of a three-layer composite sheet metal in which a plastic layer is embedded between two covering layers of iron or steel.

ADVANTAGE OF THE INVENTION

The cooling fan according to the invention, has an advantage that due to the use of an electric motor of the external rotor type, it is embodied in a very compact, space-saving manner and the motor, it has a low noise level that is sufficient for cooling fan purposes so that an expensive manufacture of the pole housing of the electric motor out of composite sheet metal can be eliminated. This is achieved according to the invention because, the fan wheel rests against the circumference of the pole housing and therefore prevents the housing from vibrating. As a result, body sound waves, which are produced by changing forces and moments acting on the pole housing, are strongly damped and can only be transmitted in a sharply reduced form via the outer surface of the pole housing. This damping action is actually not as good as when a composite sheet metal is used for the pole housing, but it is completely sufficient for cooling fan purposes since the remaining noise still being transmitted by the rotor falls below the noise level of the fan wheel. Among other things, the quality of the damping depends largely on the forces with which the fan wheel presses against the pole housing at the contact points and also depends on the damping action of the fan wheel itself, which constitutes a spring-damper system. The damping action of the cooling fan is influenced by the geometric design and by the choice of material.

Advantageous improvements and updates of the cooling fan are possible measures set forth hereinafter.

According to a preferable embodiment form of the invention, the contact points of the fan wheel are located at the points of the pole housing in which the greatest vibrational amplitudes occur in the pole housing. Since the bell-, cap-, or cup-shaped pole housing exhibits the greatest vibrational amplitude at the leading edge, similar to a bell, according to a preferred embodiment of the invention, the contact points of the fan wheel are intentionally placed in this vicinity and are preferably embodied by damping projections which protrude inward radially from the end face of the fan wheel disposed in the vicinity of the bell edge of the pole housing and are of one piece with this end face.

This is achieved in a structurally simple manner according to an advantageous embodiment of the invention, the fan wheel is provided with a cylindrical wheel part which axially encompasses the pole housing at least partially with a radial gap and is supported against the pole housing by the above-mentioned damping projections, which are preferably disposed evenly distributed over the circumference, wherein in order to improve the damping action, axial slots are formed into the cylindrical wheel part of the fan wheel, preferably distributed evenly over the circumference.

Alternatively or in addition, according to an advantageous embodiment of the invention, additional damping shaped parts are disposed between the fan wheel and the pole housing. In the embodiment of the fan wheel with a cylindrical wheel part, with a shaped part embodied as a ring, this shaped part is contained in a diametrically enlarged end section of the pole housing, wherein the shaped part is supported against the inner wall of the end section and against the outer circumference of the pole housing.

BRIEF DESCRIPTION OF THE DRAWINGS

The invention will be explained in more detail below in conjunction with exemplary embodiments shown in the drawings.

DESCRIPTION OF THE EXEMPLARY EMBODIMENTS

Figure 1:
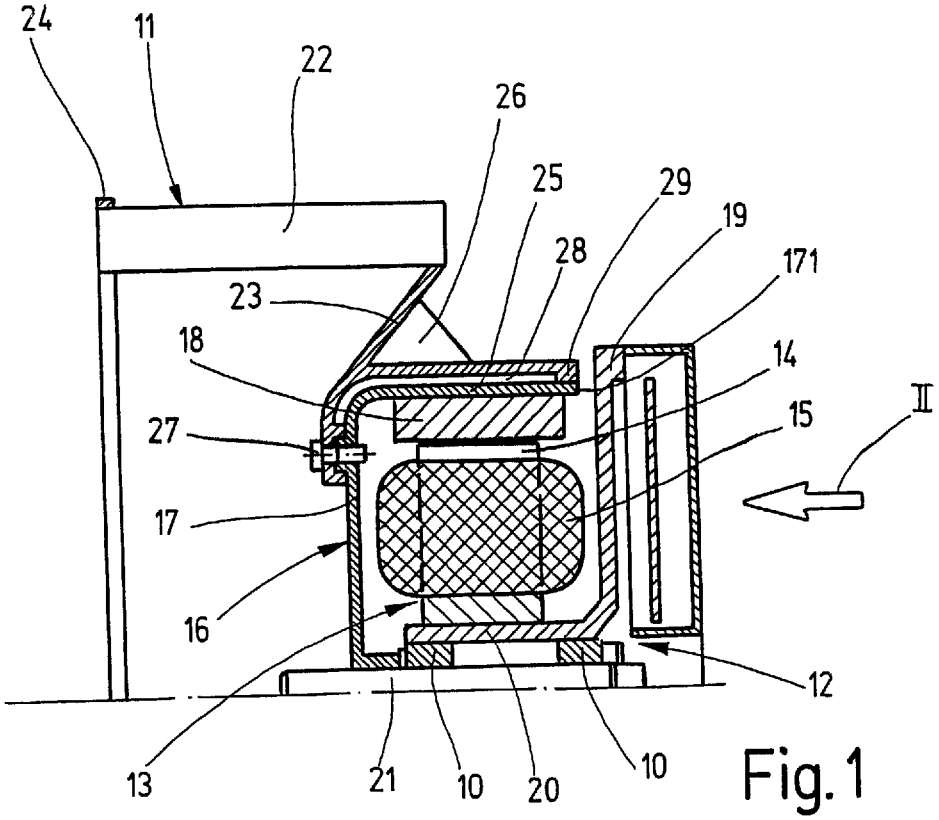
FIG. 1 shows a detail of a partial longitudinal section through cooling fan for a vehicle.

The cooling fan (ventilator or blower) shown with its upper half section in a longitudinal section in FIG. 1 has a fan wheel 11 and an electric motor 12 of the external rotor type which drives the fan wheel 11. As usual, the electric motor has a stator 13 which supports an armature winding 15 in a grooved packet of iron plates 14, and a rotor 16, which has a bell-, cap-, or cup-shaped pole housing 17 encompassing the stator 13, as well as excitation poles 18 that are fastened to the cylindrical interior wall of the pole housing 17 and are embodied here as permanent magnet segments. The stator 13 is fastened to a base body 19 with a concentric hollow support 20 that is formed onto the base body and of one piece with the base body, wherein the packet of iron plates 14 is pressed in a rotationally fixed manner against the hollow support 20. On the inside of the hollow support 20, a motor-, rotor-, or driven shaft 21 is supported in rotary fashion by means of bearing elements 10 and is secured against axial movement. The pole housing 17 is press-fitted onto the driven shaft 21.

The fan wheel 11 has a ring of blades or wings 22, which are fastened equidistantly disposed from one another in the circumference direction on the outer circumference of an annular piece 23 and are reinforced with a continuous support ring 24. A cylindrical wheel part 25 extends from the annular piece 23 and is reinforced with radially extending ribs 26 on the annular piece 23. After the annular piece 23 has been fastened to the outside of the bell bottom of the pole housing 17, which in FIG. 1 is carried out by means of screw connections 27, but can also be realized by means of clips, the cylindrical wheel part 25 encompasses the pole housing 17 while leaving a radial gap 28 and is supported against the outer circumference of the pole housing 17 by means of contact projections 29 that are disposed equidistantly over the circumference and protrude radially inwardly on its end face disposed in the vicinity of the bell edge 171 of the pole housing 17.

Figure 2:
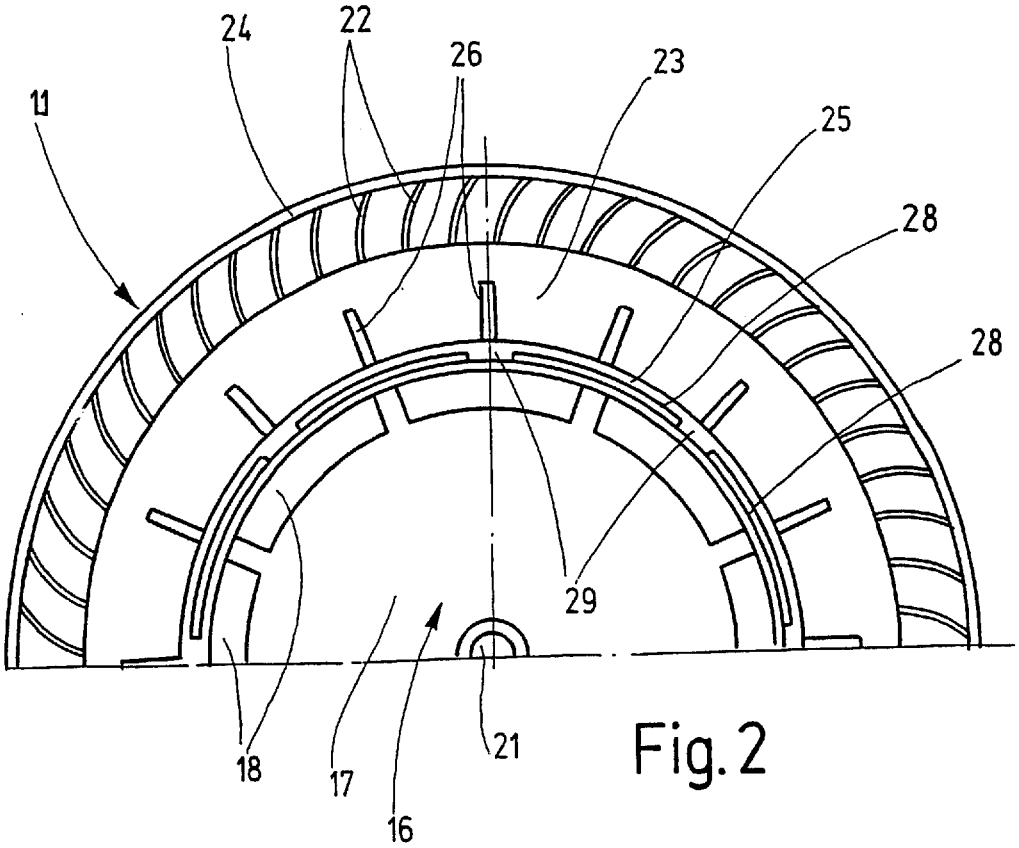
FIG. 2 shows a detail of a partial view in the direction of arrow II in FIG. 1, with the stator of the electric motor removed.
Figure 3:
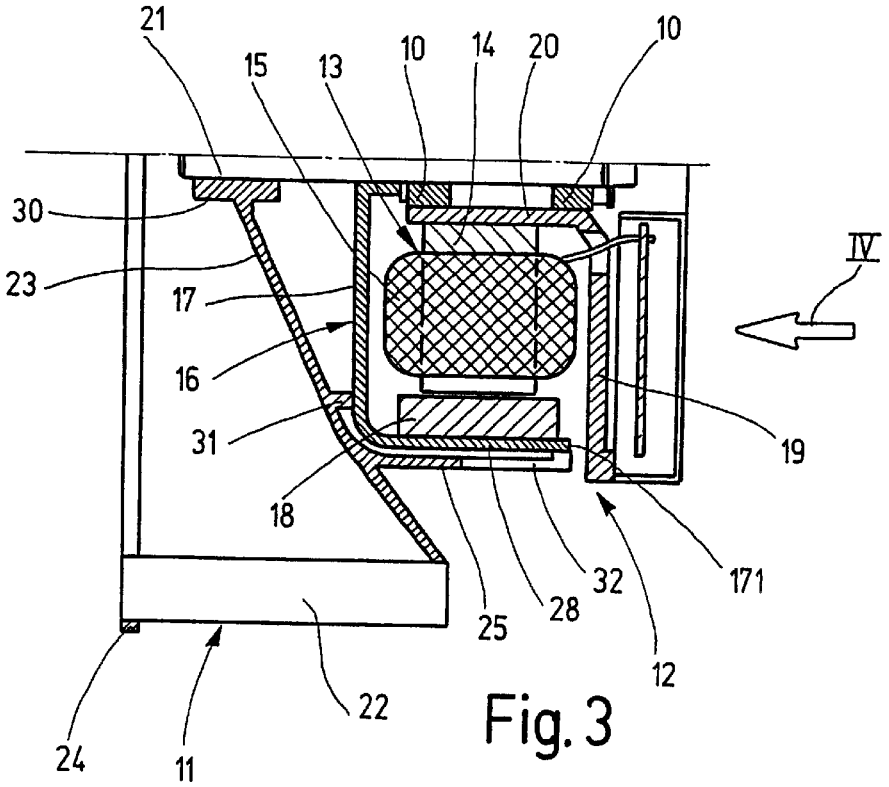
FIG. 3 shows a partial depiction similar to FIG. 1, with a modified fan wheel.
Figure 4:
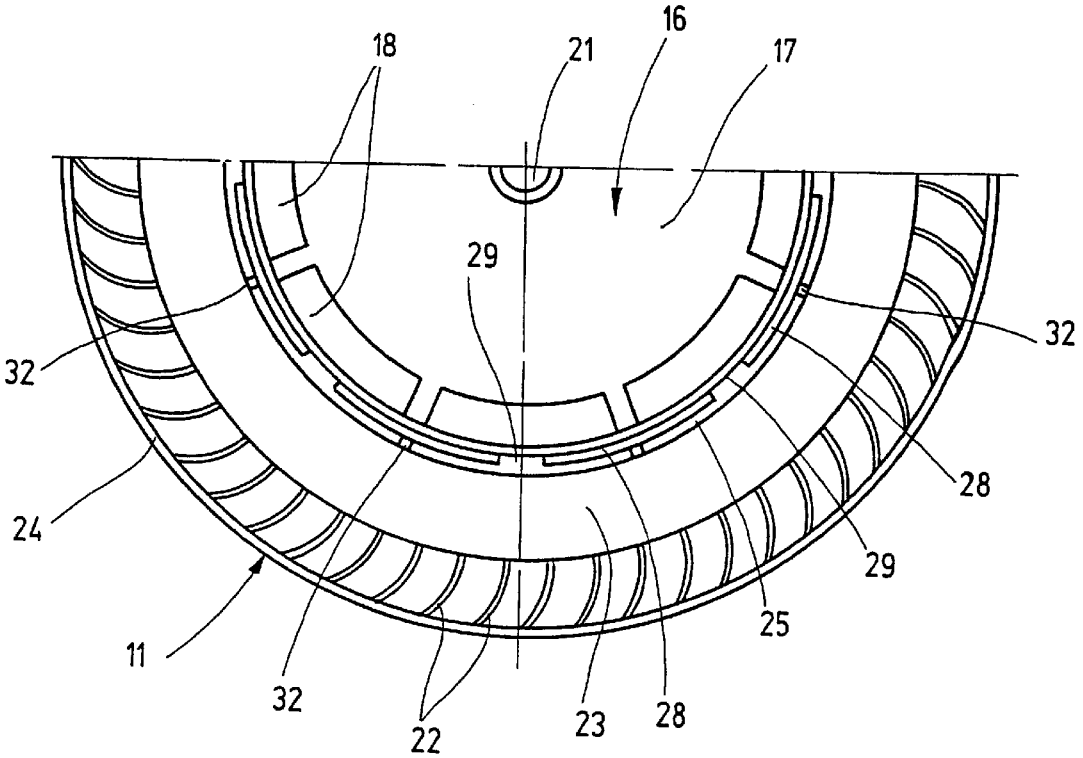
FIG. 4 shows a detail of a partial view of the cooling fan in the direction of arrow IV in FIG. 3, with the stator of the electric motor removed.

According to another exemplary embodiment, the cooling fan shown in FIG. 4, with its lower half section likewise in a longitudinal section, differs from the above-described cooling fan by the fact that the fan wheel 11 is not fastened to the pole housing 17, but with a hub 30 embodied inside the annular piece 23, the hub is press-fitted onto the driven shaft 21 and is axially supported with an axial piece 31 externally against the bell bottom of the pole housing 17. Otherwise, this cooling fan corresponds to the cooling fan described in conjunction with FIGS. 1 and 2 so that parts which are the same are provided with the same reference numerals and in this regard, the explanations in conjunction with FIGS. 1 and 2 also apply here.

In order to optimize the damping of the pole housing 17 of the rotor 16 produced by the fan wheel 11, axial slots 32 are let into the cylindrical wheel part 25 of the fan wheel 11 and these slots are disposed equidistantly over the circumference and extend freely on the end face of the wheel part 25 oriented toward the bell edge 171.

Figure 5:
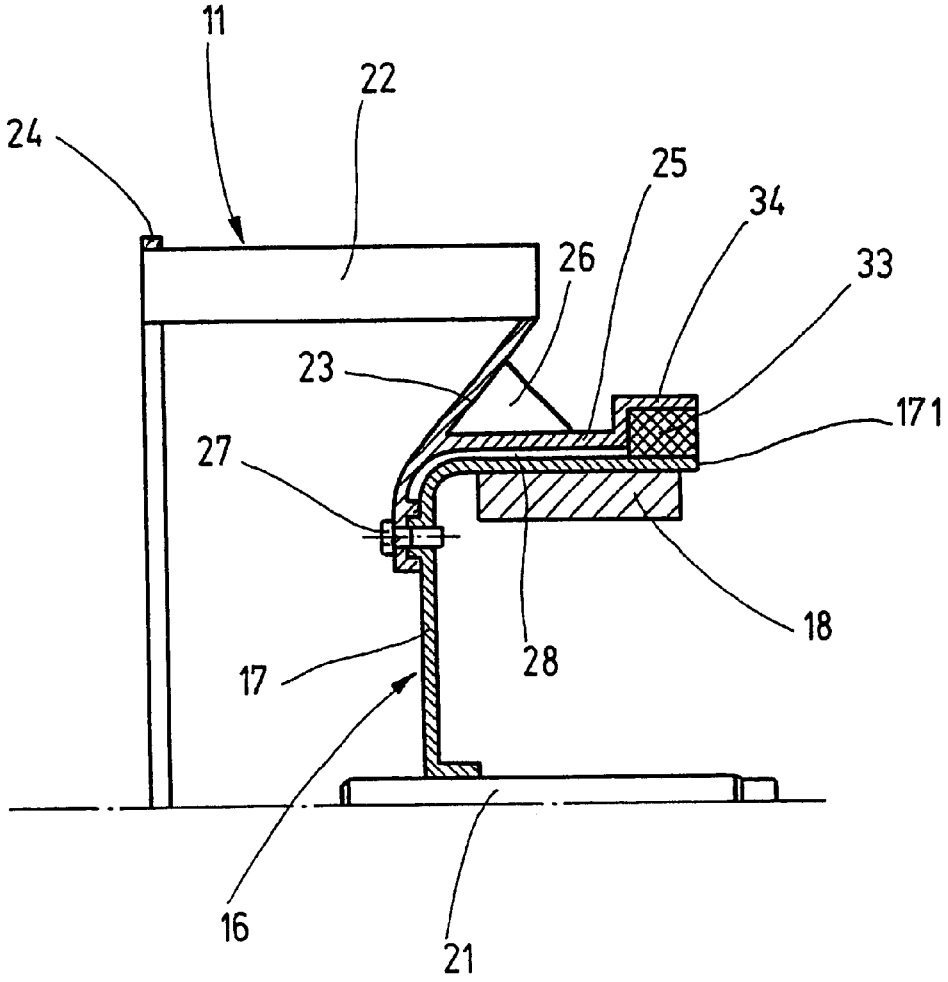
FIG. 5 shows a detail of a partial longitudinal section of a cooling fan according to another exemplary embodiment, with the stator of the electric motor removed.

The cooling fan shown in a detail of a longitudinal section in FIG. 5 corresponds structurally to the cooling fan that is described above and is depicted in FIGS. 1 and 2, with the difference that the damping of the pole housing 17 of the rotor 16 does not take place by means of contact projections 29 which are formed onto the cylindrical wheel part 25 of the fan wheel 11 and are of one piece with it, but rather by shaped parts 33. The shaped parts 33 are in turn supported against the walls of the cylindrical wheel part 25 and pole housing 17 that are oriented toward one another. In the exemplary embodiment of FIG. 5, on its end face disposed in the vicinity of the bell edge 171 of the pole housing 17, the cylindrical wheel part 25 is provided with a diametrically enlarged end section 34 which encompasses the shaped part 33 that is embodied as a ring. Alternatively, instead of a shaped ring part, individual shaped pieces or parts can also be disposed equidistantly over the circumference of the wheel part 25 and pole housing 17, which are then received into corresponding recesses of the cylindrical wheel part 25.

In all of the exemplary embodiments of the cooling fan described above and shown in FIGS. 1 to 5, the fan wheel 11 and the pole housing 17 are designed by means of material selection and geometry so that they have a considerably different natural resonance.

What is claimed is:

1. A cooling fan for vehicles, which comprises a fan wheel (11) equipped with blades and an electric motor (12) that drives the fan wheel (11), a stator (13), and a rotor (16) that is supported in a rotationally fixed manner on a driven shaft (21), the rotor (16) is embodied as an external rotor with a bell-shaped pole housing (17) encompassing the stator (13), and that the fan wheel (11) is rotationally fixed in relation to the pole housing (17) and axially encompasses the pole housing at least partially and contacts an outer circumference of the pole housing (17) at a number of spaced contact points (29) in such a way that mechanical oscillations of the bell-shaped pole housing (17) are damped.

2. The cooling fan according to claim 1, in which the contact points (29) of the fan wheel (11) rest against corresponding points of the pole housing (17) at which greatest vibrational amplitudes occur in the pole housing (17).

3. The cooling fan according to claim 2, in which the contact points (29) are disposed along a bell edge (171) of the pole housing (17).

4. The cooling fan according to claim 3, in which the contact points (29) are distributed equidistantly over the circumference of the pole housing (17).

5. The cooling fan according to claim 1, in which damping shaped parts (33) are disposed between the fan wheel (11) and the pole housing (17).

6. The cooling fan according to claim 2, in which damping shaped parts (33) are disposed between the fan wheel (11) and the pole housing (17).

7. The cooling fan according to claim 3, in which damping shaped parts (33) are disposed between the fan wheel (11) and the pole housing (17).

8. The cooling fan according to claim 3, in which the fan wheel (11) has a cylindrical wheel part (25), said fan wheel part axially encompasses the pole housing (17) at least partially with a radial gap (28) and on an end face of the fan wheel part disposed in the vicinity of the bell edge (171) of the pole housing (17), the fan wheel part is supported against the pole housing (17) by means of damping projections that protrude radially inward at the contact points (29) on an end face of the cylindrical wheel part disposed in the vicinity of the bell edge (171) of the pole housing (17).

9. The cooling fan according to claim 4, in which the fan wheel (11) has a cylindrical wheel part (25), said fan wheel part axially encompasses the pole housing (17) at least partially with a radial gap (28) and on an end face of the fan wheel part disposed in the vicinity of the bell edge (171) of the pole housing (17), the fan wheel part is supported against the pole housing (17) by means of damping projections that protrude radially inward at the contact points (29) on an end face of the cylindrical wheel part disposed in the vicinity of the bell edge (171) of the pole housing (17).

10. The cooling fan according to claim 5, in which the fan wheel (11) has a cylindrical wheel part (25), said fan wheel part axially encompasses the pole housing (17) at least partially with a radial gap (28) and on an end face of the fan wheel part disposed in the vicinity of the bell edge (171) of the pole housing (17), the fan wheel part is supported against the pole housing (17) by means of damping projections that protrude radially inward at the contact points (29) on an end face of the cylindrical wheel part disposed in the vicinity of the bell edge (171) of the pole housing (17).

11. The cooling fan according to claim 8, in which axial slots (32) are let into the cylindrical wheel part (25) of the fan wheel (11), distributed evenly over the circumference, and that the axial slots (32) extend freely on the end face of the wheel part (25) oriented toward the bell edge (171) of the pole housing (17).

12. The cooling fan according to claim 9, in which axial slots (32) are let into the cylindrical wheel part (25) of the fan wheel (11), distributed evenly over the circumference, and that the axial slots (32) extend freely on the end face of the wheel part (25) oriented toward the bell edge (171) of the pole housing (17).

13. The cooling fan according to claim 10, in which axial slots (32) are let into the cylindrical wheel part (25) of the fan wheel (11), distributed evenly over the circumference, and that the axial slots (32) extend freely on the end face of the wheel part (25) oriented toward the bell edge (171) of the pole housing (17).

14. The cooling fan according to claim 3, in which the fan wheel (11) has a cylindrical wheel part (25), which axially encompasses the pole housing (17) at least partially with a radial gap (28) and on an end face of the cylindrical wheel part in the vicinity of the bell edge (171) of the pole housing (17), the wheel part is provided with a diametrically enlarged end section (34) for receiving shaped parts (33) located at the contact points (29), and that the shaped parts (33) constitute a complete ring which is supported against an inner wall of the end section (34) and against an outer wall of the pole housing (17).

15. The cooling fan according to claim 4, in which the fan wheel (11) has a cylindrical wheel part (25) which axially encompasses the pole housing (17) at least partially with a radial gap (28) and on an end face of the cylindrical wheel part in the vicinity of the bell edge (171) of the pole housing (17), the wheel part is provided with a diametrically enlarged end section (34) for receiving shaped parts (33) located at the contact points (29), and that the shaped parts (33) constitute a complete ring which is supported against an inner wall of the end section (34) and against an outer wall of the pole housing (17).

16. The cooling fan according to 8, in which the cylindrical wheel part (25) is formed onto an annular piece (23) connected to the pole housing (17) or to the driven shaft (21), and on an outer edge of the annular piece, supports a ring of fan blades (22).

17. The cooling fan according to 11, in which the cylindrical wheel part (25) is formed onto an annular piece (23) connected to the pole housing (17) or to the driven shaft (21), and on an outer edge of the annular piece, supports a ring of fan blades (22).

18. The cooling fan according to 14, in which the cylindrical wheel part (25) is formed onto an annular piece (23) connected to the pole housing (17) or to the driven shaft (21), and on an outer edge of the annular piece, supports a ring of fan blades (22).

19. The cooling fan according to claim 16, in which the annular piece (23) is fastened, to a bell bottom of the pole housing (17).

20. The cooling fan according to claim 16, in which the annular piece (23) is press-fitted onto the driven shaft (21) and is axially supported against the bell bottom of the pole housing (17).

21. The cooling fan according to claim 1, in which the pole housing (17) and the fan wheel (11) have a different natural resonance.

22. A cooling fan for vehicles, which comprises a fan wheel (11) equipped with blades and having a cylindrical wheel part (25) and an electric motor (12) that drives the fan wheel (11), a stator (13), and a rotor (16) that is supported in a rotationally fixed manner on a driven shaft (21), the rotor (16) is embodied as an external rotor with a bell-shaped pole housing (17) encompassing the stator (13), and that the fan wheel (11) is rotationally fixed in relation to the pole housing (17) and axially encompasses the pole housing at least partially with a radial gap between the cylindrical wheel part (25) and the pole housing and contacts an outer circumference of the pole housing (17) at a number of spaced contact points (29).

* * * * *